US011299975B2

(12) United States Patent
Harvey

(10) Patent No.: US 11,299,975 B2
(45) Date of Patent: Apr. 12, 2022

(54) AT-BIT SENSING OF ROCK LITHOLOGY

(71) Applicant: Peter R. Harvey, Houston, TX (US)

(72) Inventor: Peter R. Harvey, Houston, TX (US)

( * ) Notice: Subject to any disclaimer, the term of this patent is extended or adjusted under 35 U.S.C. 154(b) by 0 days.

(21) Appl. No.: 16/855,169

(22) Filed: Apr. 22, 2020

(65) Prior Publication Data

US 2020/0340351 A1 Oct. 29, 2020

Related U.S. Application Data

(60) Provisional application No. 62/839,900, filed on Apr. 29, 2019.

(51) Int. Cl.
*E21B 44/04* (2006.01)
*E21B 7/06* (2006.01)
(Continued)

(52) U.S. Cl.
CPC ..... *E21B 44/04* (2013.01); *E21B 7/06* (2013.01); *E21B 44/00* (2013.01); *E21B 45/00* (2013.01);
(Continued)

(58) Field of Classification Search
CPC ..... E21B 44/00; E21B 44/02; E21B 44/04; E21B 44/06; E21B 44/08; E21B 45/00;
(Continued)

(56) References Cited

U.S. PATENT DOCUMENTS 5,842,149 A * 11/1998 Harrell ..... E21B 47/00 702/9
8,100,196 B2 * 1/2012 Pastusek ..... E21B 21/08 175/40

(Continued)

*Primary Examiner* — Tara Schimpf
(74) *Attorney, Agent, or Firm* — Richard A. Fagin

(57) ABSTRACT

A method is described for determining a measure of geo-mechanical strength of subterranean rock at the cutting surface of a drill bit during drilling using a single measurement related to mechanical power at the drill bit. This measurement in combination with a measure of volumetric rate of rock failure defines an expression for mechanical specific energy (SMSE). SMSE is the mechanical power at the drill bit divided by volumetric rate of rock failure over any time interval. A method is described for predicting geo-mechanical and physical properties (lithology) of subterranean rock at the cutting surface of a drill bit during drilling operations using machine learning (data analytical) model(s). Said models are driven by a set of subterranean measurements related to the structural, physical response of subterranean rock mechanical failure in combination with the measure of SMSE. The geo-mechanical and physical properties of subterranean rock may include measures of rock geo-mechanical strength, unconfined compressive strength (UCS), porosity, density, natural gamma ray, and/or borehole natural fracture network. Said machine learning models are developed (or trained) using historical drilling data sets of subterranean sensors through correlation to an accepted or accurate measure of subterranean rock properties. Said predicted measures may be further processed along with other data from oilfield development operations to provide vital information for drilling performance, well bore placement and engineered completion design.

26 Claims, 3 Drawing Sheets

(51) Int. Cl.

| | |
|---|---|
| ***E21B 47/00*** | (2012.01) |
| ***E21B 45/00*** | (2006.01) |
| ***E21B 44/00*** | (2006.01) |
| ***E21B 49/00*** | (2006.01) |

(52) U.S. Cl.
CPC ..... *E21B 47/00* (2013.01); *E21B 49/003* (2013.01); *E21B 2200/20* (2020.05); *E21B 2200/22* (2020.05)

(58) Field of Classification Search
CPC ..... E21B 47/00; E21B 47/003; E21B 47/013; E21B 2200/20; E21B 2200/22
See application file for complete search history.

(56) References Cited

U.S. PATENT DOCUMENTS

| | | | | |
|---|---|---|---|---|
| 2018/0094518 | A1* | 4/2018 | Kpetehoto | E21B 44/02 |
| 2019/0345809 | A1* | 11/2019 | Jain | E21B 47/26 |

* cited by examiner

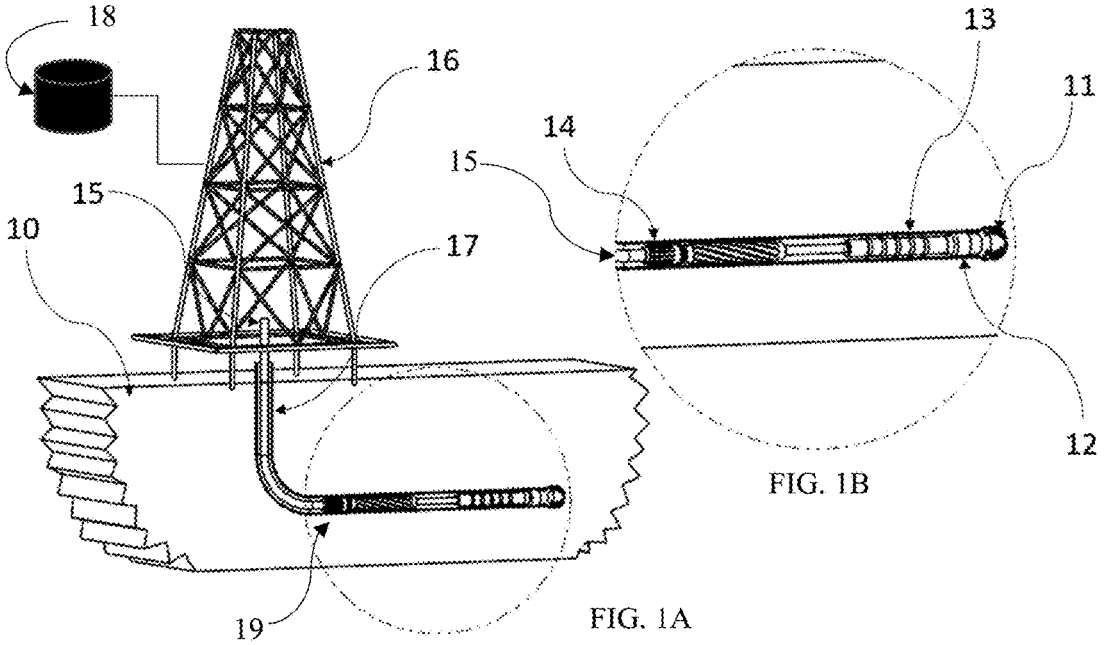
FIG. 1B
FIG. 1A
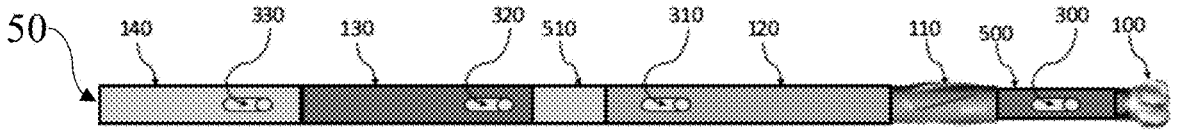
FIG. 2
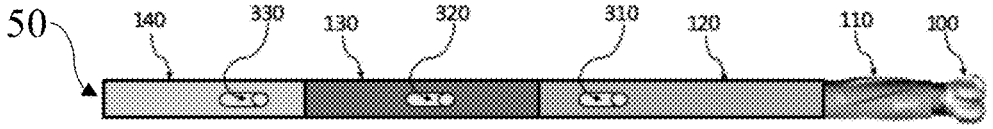
FIG. 3

AT-BIT SENSING OF ROCK LITHOLOGY

CROSS REFERENCE TO RELATED APPLICATIONS

Priority is claimed from U.S. Provisional Application No. 62/839,900 filed on Apr. 29, 2019, and incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

The present disclosure relates to the field of subterranean well drilling. More specifically, the disclosure relates to methods to determine and predict physical parameter measurements that would take place directly at the position of a drill bit while drilling a subsurface wellbore.

Improvements in the development of unconventional petroleum reservoirs, particularly in the United States, have led to significant technology advances in both completions and drilling of wells used to drain such unconventional reservoirs. The efficient manner and sheer number of wells actively being drilled in the United States have been described as "factory drilling" where thousands of highly inclined and/or horizontal wells are being completed each year in several geologic basins.

Completion technology advancements have led to large production improvements in unconventional petroleum resources as to both economics and ultimate resource recovery. However, cost structures and substantial variance in performance from pad to pad, well to well, and stage to stage along lateral (highly inclined or horizontal) portions of such wellbores have recently pushed the industry from 'geometric' toward 'engineered' completions. Geometric completions, whereby lateral sections of a wellbore have a large number of equally spaced treatment "stages" that are individually stimulated through, e.g., hydraulic fracturing, have demonstrated significant performance variance from stage to stage in any particular well. It is not uncommon that only a fraction of the total number of stages in some such wells effectively contributes to overall production. It is believed that substantial variability of rock properties along the length of such lateral sections is a contributing factor to production performance inconsistency. Engineered completion techniques focus on grouping rocks of similar mechanical properties or similar lithology to determine treatment, e.g., fracturing parameters. The process of grouping similar types of rock formations to within tailored stage length intervals has demonstrated measurable improvement in production results.

Drilling performance improvements have reduced associated time and costs substantially. Automation of wellbore directional drilling aids well drillers by making automated recommendations for optimum well trajectory "steering" based on real time formation and drilling measurement data and surface-measured data. Data driven logic has enable efficient directional steering in terms of savings in needed manpower, improved rate of penetration (ROP) and maintaining the well trajectory within target formations or zones. Target zones may be predefined in well construction plans based on existing subsurface rock formation composition (lithology) records.

Geo-steering, a term used to describe using formation physical property measurements to adjust well trajectory during drilling, has been used to actively adjust the well trajectory, and thereby revise predefined well plans based on actual measurements of formation physical properties. Geo-steering has as a primary objective optimally to place the well within the target zone while addressing potential hazards as they may arise. The ongoing need to lower operating costs, reduce lost drilling tool risks, and demand for design simplicity of drilling assemblies has led to the use of natural gamma ray detectors as the principal lithology measurement for geo-steering. Azimuthal, or directional, natural gamma ray measurements used in connection with substantially continuous well trajectory inclination measurements are used to steer wells from as closely to the drill bit as practical.

Two widely used types of drilling assemblies are deployed in the construction of directional (including highly inclined and horizontal) subterranean wellbores, these being steerable drilling motors and motorized rotary steerable systems (RSS). While drilling lateral sections with either of these types of drilling assemblies, a measurement while drilling (MWD) tool is generally located above the drilling motor resulting in geo-steering, e.g., gamma ray, sensors being placed in 50 feet or more behind the drill bit. There are tools that house sensors and sensor systems adjacent to the drill bit, but such systems have added operational complexity and cost.

Near-bit or at-bit sensor systems can provide measurements of, among other parameters, well inclination, natural gamma ray intensity and directional gamma ray intensity from closely behind the drill bit. Such sensor systems typically use wireless electromagnetic (EM) short hop telemetry or hard-wired drilling tools to convey the measurements to an MWD tool located behind the drilling motor, which tool is capable of transmitting the data to the surface, or rig site, using known telemetry methods such as drilling mud pressure modulation. The at-bit sensor systems may be packaged in dedicated drill collars that may range in length from 24 inches to 30 inches.

For steerable drilling motor assemblies, near-bit sensor system collars add undesirable length that can adversely affect drilling performance. For motorized RSS, where a controllable steering mechanism is placed directly behind the drill bit, it is not practical to place a dedicated sensor system collar between the RSS and the drill bit. Some RSS tools have integrated sensors to provide directional and natural gamma ray measurements that are only several feet behind the drill bit, but these RSS sensors are expensive to operate and maintain.

At-bit lithology-related parameter measurements are therefore needed for geo-steering to enhance optimally placing wellbores for unconventional resources. However, existing at-bit sensor systems add considerable operating costs as well as complexity. Therefore, they are infrequently justified for deployment.

SUMMARY

The present disclosure relates in general to determining and predicting physical parameter measurements proximate a drill bit while drilling a subsurface wellbore. These determinations and predictions may be made by using a subterranean determination of mechanical power exerted by the drill bit in addition to measuring structural and dynamic response of the rock penetration (breaking, shearing or destruction) with a set of sensors housed conveniently, and not directly within or immediately adjacent to the drill bit. The determined and predicted measurements may be used in geo-steering and engineered completions for enhancing construction of subterranean wells. The determined and predicted measurements included may comprise geo-mechanical and physical properties (rock mineral composition, "lithology") of subterranean rock.

A method according to one aspect of the present disclosure for determining mechanical specific energy of a drill bit drilling a subsurface formation, wherein the drill bit is rotated by a drilling motor in a drilling assembly, includes measuring a parameter related to torque applied to the drill bit. A parameter is measured related to rotational speed of the drill bit using a measurement made on a side of the drilling motor opposite to the drill bit. A volumetric rate of penetration of the drill bit through the subsurface formation is determined and the mechanical specific energy from the parameter related to torque, the parameter related to rotational speed and the volumetric rate of penetration.

Some embodiments further comprise using the calculated mechanical specific energy to adjust a trajectory of a wellbore created by the drilling.

In some embodiments, the parameter related to rotational speed comprises magnetic field amplitude.

In some embodiments, the parameter related to rotational speed comprises acceleration.

In some embodiments, the parameter related to torque comprises torsional strain.

A method according to another aspect of the present disclosure for determining power of a drill bit drilling a subsurface formation, wherein the drill bit is rotated by a drilling motor in a drilling assembly, comprises measuring a parameter related to torque applied to the drill bit. A parameter related to rotational speed of the drill bit is measured using a measurement made on a side of the drilling motor opposite to the drill bit. The power is calculated from the parameter related to torque and the parameter related to rotational speed.

Some embodiments further comprise using the calculated power to adjust a trajectory of a wellbore created by the drilling.

In some embodiments, the parameter related to rotational speed comprises magnetic field amplitude.

In some embodiments, the parameter related to rotational speed comprises acceleration.

In some embodiments, the parameter related to torque comprises torsional strain.

A method according to another aspect of the disclosure for predicting a lithology-related parameter of a formation at a drill bit during drilling a wellbore includes measuring a parameter related to power expended at the drill bit during the drilling. A parameter is measured related to vibration energy in a drilling assembly during drilling. The measured parameter related to power and the measured parameter related to vibration energy and corresponding measurements of the lithology-related parameter are used as input to train a machine learning model. The measured parameter related to power and the measured parameter related to vibration energy are used in the trained machine learning model to predict a value of the lithology-related parameter at the drill bit.

In some embodiments, the parameter related to power comprises torque at the drill bit and rotational speed of the drill bit.

In some embodiments, the parameter related to rotational speed comprises magnetic field amplitude.

In some embodiments, the parameter related to rotational speed comprises acceleration.

In some embodiments, the parameter related to torque comprises torsional strain.

In some embodiments, the parameter related to vibration comprises axial acceleration, lateral acceleration and rotational acceleration.

In some embodiments, the lithology-related parameter comprises at least one of density, neutron porosity, gamma ray radiation, resistivity and acoustic velocity.

In some embodiments, the corresponding measurements are made by at least one sensor disposed on the drilling assembly on a side of a drilling motor opposed to a side thereof on which the drill bit is disposed.

Other aspects and possible advantages will be apparent from the description and claims that follow.

BRIEF DESCRIPTION OF THE DRAWINGS

FIG. 1A shows a schematic diagram depicting a wellsite with a surface sensor system.

FIG. 1B, shows a detail of part of FIG. 1A, including a LWD/MWD tool, a drill bit, and a drilling motor with driveshaft.

FIG. 2 depicts a view of a bottom hole assembly with multiple sensor systems with the drill bit.

FIG. 3 depicts a view of a similar but alternative bottom hole assembly to that depicted in FIG. 2.

DETAILED DESCRIPTION

Figure 4:
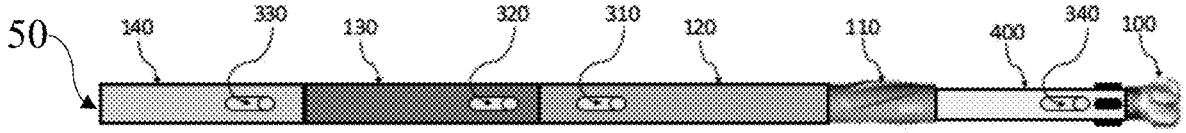
FIG. 4 depicts a view of yet another bottom hole assembly commonly referred to as a motorized rotary steerable system (RSS).

The present disclosure provides methods to determine and predict measurements directly at the position of a drill bit which do not adversely affect drilling assembly steering performance, and at a small fraction of the cost of using near-bit or at-bit sensor systems.

FIG. 1A shows a schematic diagram of a drilling unit 16 at a wellsite with a surface sensor system 18 for obtaining and storing measurements of drilling parameters as well as parameters measured by a downhole tool (FIG. 1B) having a sensor assembly disposed adjacent to a drill bit (11 in FIG. 2). As shown in FIG. 1A, the wellsite may be a land-based wellsite, but apparatus and methods according to the present disclosure are equally applicable to marine drilling operations. The wellsite may have a wellbore 17 which has been formed in the subsurface to access valuable fluids in one or more subsurface reservoirs, shown generally at 10.

The drilling unit 16 may be operated to rotate a drilling tool assembly 19. The drilling tool assembly 19 may include, and referring to FIG. 1B, a logging while drilling and/or measurement while drilling (LWD/MWD) tool 14, a drill bit 11, a drilling (mud) motor 13 with driveshaft 12 and a drill string 15 extending to the drilling unit (16 in FIG. 1A). The drilling unit (16 in FIG. 1A) may comprise a hoisting device and a controller etc., none shown separately for clarity.

FIG. 2 shows a view of an example embodiment of a bottom hole assembly (BHA) 50 disposed at the lower end of the drill string (see 15 in FIG. 1B) which may include multiple sensor systems, including sensor associated with the drill bit (show in FIG. 2 and following figures at 100). A near-bit or at-bit sensor assembly 500 may include a wireless short hop data communication system (not shown separately) and a sensor system 300. The BHA 50 may comprise a conveyance/mud drilling motor stabilized bearing pack 110, a drilling motor assembly 120 with a power section (e.g., a positive displacement type or turbine type device to convert drilling fluid flow to rotational energy) having a sensor system 310. The BHA 50 may comprise a logging while drilling (LWD) assembly 130 including an LWD sensor system 320, wireless short hop data communication system 510, and a measurement while drilling (MWD) assembly 140 including an MWD sensor system 330. The BHA 50 may include any suitable drill bit, e.g., as shown at 100, for forming the wellbore (as shown at 17 in FIG. 1A). The BHA 50 may have a flow path for allowing fluids, such as drilling mud or air, to flow through internal channels or cavities in order to lubricate the drill bit 100 and/or carry away cuttings. In some embodiments, the LWD and MWD sensor systems 320, 330 may be located within the internal flow path of the BHA 50 as well as integral to any structural members of the BHA 50 during drilling operations. The LWD sensor system 320 may comprise one or more sensors for measuring petrophysical properties of the formations surrounding the well, including without limitation and in any combination, sensors such as natural gamma radiation, bulk density, neutron porosity, acoustic travel time and electrical resistivity. The at-bit sensor system 300 may comprise, for example and without limitation, tool inclination sensors, a natural gamma radiation sensor and a torque sensor. The MWD sensor system 330 may comprise sensors, for example and without limitation, magnetometers and accelerometers, the measurements from which may be used in combination to determine geomagnetic and/or geodetic orientation and gravity orientation of the drilling assembly.

FIG. 3 shows a view of an example embodiment of another type of bottom hole assembly (BHA) 50 similar to that shown in FIG. 2 in which a near-bit or at-bit sensor system (500 in FIG. 2) including a wireless short hop communication system comprises an at bit sensor system (300 in FIG. 2), where the wireless short hop communication system (510 in FIG. 2) has been replaced by a processor (e.g., disposed in MWD system 140) having programmed or stored thereon developed machine learning models for use with the output of any or all of the near- or at-bit, MWD and LWD sensor system(s) 330, 320, and/or 310 as may apply in any particular embodiment.

FIG. 4 shows a view of another example embodiment of a bottom hole assembly (BHA) 50 commonly referred to as a motorized rotary steerable system (RSS) including a near-bit or at-bit sensor system 340 placed proximately behind the drill bit 100. Other components of the BHA 50 may be similar to those explained with reference to FIGS. 2 and 3. Measurements related to mechanical power at the drill bit, and developed machine learning models may be integrated into sensor system(s) 340, 330, 320, and/or 310, but most practically in the MWD sensor system 330 allowing for BHA 50 to be operated without the more complex LWD sensor system 320 and without near-bit sensor system (500, 510 in FIG. 2). That is, the intent of methods according to the present disclosure is to allow the drilling operator to use lower cost, simpler BHAs by replacing higher end LWD sensor system 320 with a lower cost MWD sensor system 330 supplemented by measurements corresponding to mechanical power at the drill bit made close to the drill bit, as well as integrated machine learning models trained on historical data to predict measurements that would have been provided by the LWD sensor system 320 on a well currently being drilled. That is, the drill bit power related measurements are used in connection with the machine learning to predict what measurements from the LWD sensor system 320 would be if they had been measured.

Figure 5:
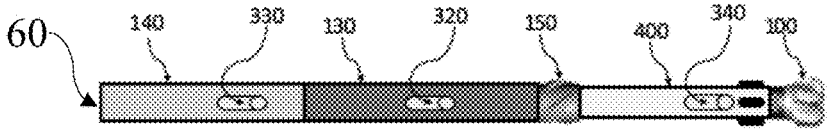
FIG. 5 depicts a non-motorized RSS removed from the bottom hole assembly.

FIG. 5 depicts a non-motorized RSS 60, where removed from the BHA are the conveyance/mud drilling motor stabilized bearing pack 110, drilling motor assembly 120 with power section (positive displacement type shown or turbine type) with sensor system 310 shown in FIG. 4. Once more, the intent is to allow the drilling operator to use lower cost, simpler BHAs by replacing the LWD sensor system 320 and near bit sensors systems (500, 510 in FIG. 2) with the MWD sensor system 330 and measurements related to mechanical power at the drill bit, as well as integrated machine learning models trained on historical data to predict measurements that would have been provided by the LWD sensor system 320 under the same circumstances.

Figure 6:
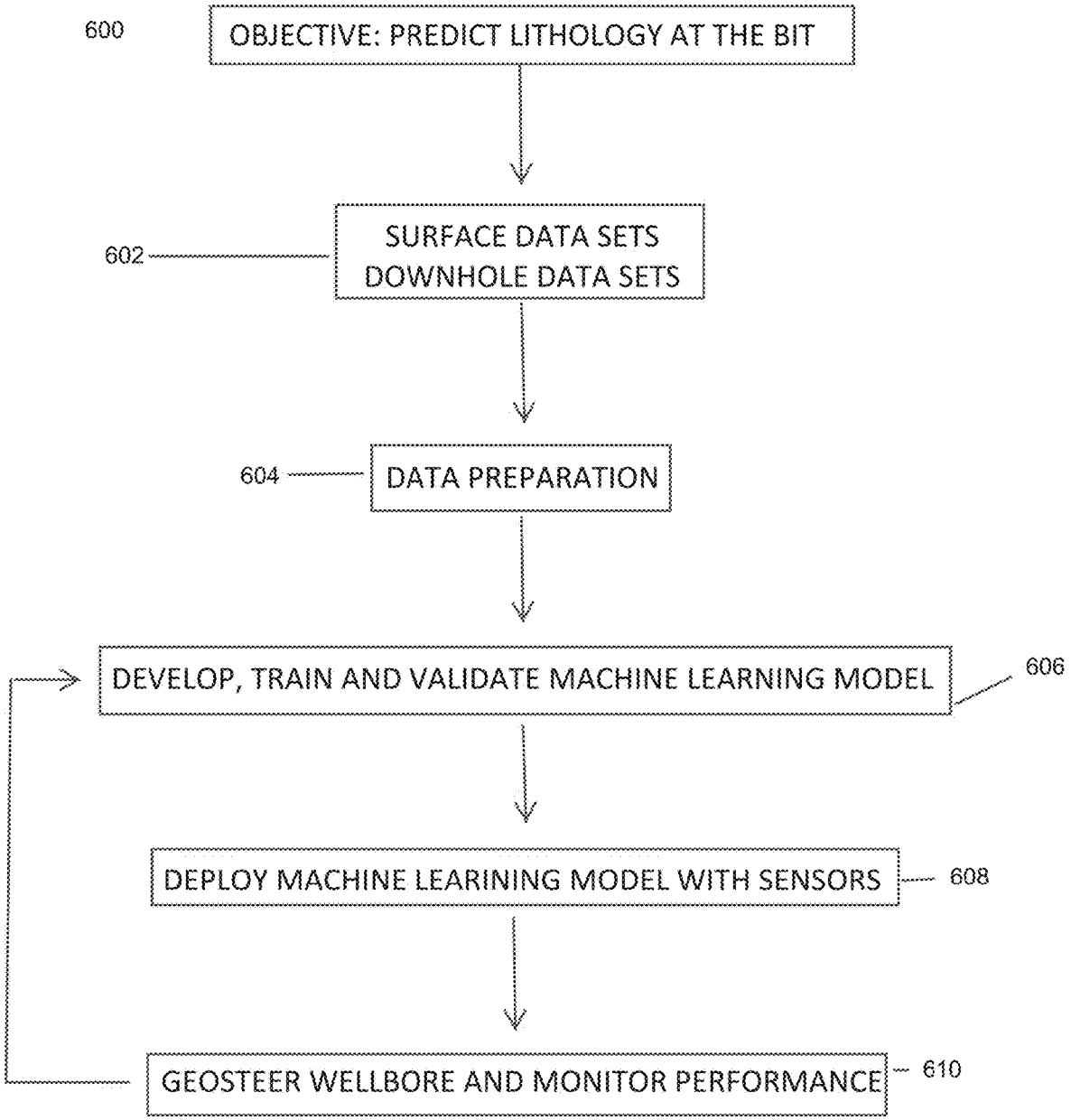
FIG. 6 depicts a flow chart of an example embodiment of a machine learning process for predicting lithology.

FIG. 6 shows a flow chart of an example embodiment of a method for providing a predicted lithology measurement at the cutting surface of the drill bit (100 in FIG. 2) using measurements from the MWD tool (140 in FIG. 2) that may be used in connection within any common BHA such as those depicted in FIG. 2, FIG. 3 or FIG. 4 with or without the LWD tool (130 in FIG. 2) and its corresponding sensor system (320 in FIG. 2) and without the use of a near-bit or at-bit sensor system (500, 510 in FIG. 2).

At 600, an objective of such a method is to predict a lithology-related measurement at the drill bit. At 602, surface-made measurements of standpipe pressure (pressure of the drilling fluid as it is pumped into the drilling tool assembly), drill bit depth and time may be obtained along with measurements made by sensors in the drilling assembly, that may include at least parameters related to torque at the drill bit, rotational speed at the drill bit, vibrational energy being generated from drilling and lithology (rock mineral composition and/or grain structure). The lithology-related sensor to bit offset (distance from the sensor measurement point to the bit) will also be included to enable adjustment for lag with respect to measurements that are related to drilling dynamics. Additionally, the drill bit, drilling motor, and BHA features may be included. Drill bit features may include at least a number of fixed cutter blades and gauge diameter. Drilling motor features may include at least a number of rotor lobes (on a progressive cavity motor), flow to rpm ratio value, and pressure drop to torque ratio value. BHA features may include at least stabilizer blade count.

At 604, measurements may be preprocessed, for example, to synchronize measurements made by the sensors in the drilling tool assembly (e.g., MWD sensors) with measurements made at the surface to generate a record of measurements with respect to depth in the wellbore. Furthermore, data sets may be filtered for drilling-only actions on the drilling unit, e.g., excluding non-drilling actions such as washing, reaming and inserting/removing the drilling assembly. Any self-evidently erroneous data may be removed from data sets. The data sets are now ready for machine learning model development.

At 606, the pre-processed data sets may be used to develop, train, and validate machine learning (ML) models. The resultant output of the machine learning models may comprise a prediction of lithology at the drill bit and such lithology may be determined as a complex function of the MWD sensor system measurements.

At 608, the developed ML model may be loaded as a subset of embedded firmware onto a microcontroller unit (MCU) or processor located in the subterranean sensor set or elsewhere in the drilling assembly as may be convenient, and as explained with reference to FIG. 3. The same set of input measurements used for the ML model development may now be processed in real time to provide a predicted value of lithology at the cutting surface of the drill bit, even though in the drilling assembly, any lithology-based sensor may be located at a substantial distance behind the drill bit or omitted entirely.

At 610, performance of the developed ML models in predicting lithology may be monitored from time to time by including measurements from the lithology-based sensor, e.g., as may be included in the LWD sensor system, and comparing such measurements with the predictions made previously. In particular, if the drilling assembly includes a different type of drill bit, drilling motor, or other structural change that will alter the response measured at the location of the subterranean sensors, then it is likely the ML models will need to be refined and/or updated. At that point, the process returns to 606 which will once again be performed to redevelop, retrain, and revalidate the ML models for subsequent use at 608. The foregoing continuous improvement or refinement process may continue as required or desired.

In methods according to the present disclosure, rock mechanical properties at the drill bit, that is, at the face of the formation being drilled by the drill bit, may be determined while the well is being drilled. Rock mechanical strength during drilling, for example, can provide a measure corresponding to mechanical power expended at the cutting surface of the drill bit using measurements from sensors placed conveniently in a commonly deployed MWD sensor arrangement, e.g., a probe-based tool located some distance behind the drill bit. A single calculated parameter may be made available for both real time operations and stored in memory, e.g., in any part of the downhole tool such as the processor explained with reference to FIG. 3. Azimuthal, or directional measurement, e.g., gamma ray, may be made and values calculated using known directional measurement "binning" methods, wherein magnetometers may measure the rotary orientation of the BHA in the wellbore, and measurements made along selected rotational orientations may be sorted according to such rotary orientation and the axial position (depth) when made.

Measurement made during drilling may be used to geosteer the well (i.e., adjust the well drilling trajectory) based on predicted at-bit lithology, as will be explained further below, from the rock mechanical strength, or directly from the determined rock mechanical strength.

Mechanical specific energy (MSE) is a parameter known in the art for determining the energy actually used to drill, or mechanically "fail" a unit volume of rock. Fail in the present context may mean breaking the rock by shearing and/or exceeding the compressive strength of the rock. MSE is known in the art to be used for drilling optimization, e.g., to maximize rate of penetration (ROP) in particular subsurface formations. Drilling operations to develop unconventional resources (UR) may, as explained above, use either steerable drilling motors or motorized rotary steerable systems (RSS) to drill extended reach "lateral" (highly inclined or horizontal) wells. Both such drilling systems may have fluid operated drilling motors comprising progressive cavity power sections, or in some instances, turbines. MSE when drilling motors are included in the BHA may written in simplified form as follows:

$$MSE=[WOB/A]+[[Ct\times\Delta P]\times[\omega ds+Cr\times Q]]/[A\times ROP] \quad (1)$$

where, WOB=axial force (weight) on the drill bit, A=cross-sectional area of the drill bit at its gauge diameter, Ct=a drilling motor constant relating fluid pressure to torque, $\Delta P$=pressure drop induced by the drilling motor, $\omega ds$=drill string rotary speed, Cr=a motor constant relating fluid flow rate through the motor to motor output speed, Q=drilling fluid flow rate, ROP=rate of penetration (rate of axial elongation of the bore hole).

The above equation for MSE may be further simplified (to simplified MSE or "SMSE") because principally drill bits used in lateral well drilling are fixed cutter or hybrid drill bits, where variation caused by MSE of the WOB term is negligible and may be ignored. Furthermore, the rotary speed term desired is simply that of the drill bit which is the summation of the drilling motor output speed and the drill string rotary speed (usually rotated from the surface such as by a top drive). Lastly, the drill bit torque may be substituted for the pressure drop term and results in the following equation:

$$SMSE=[[Tbit]\times[\omega bit]]/[A\times ROP] \text{ or,}$$

$$SMSE=Power@Bit/VROP \quad (2)$$

where, Power@Bit=mechanical power delivered at drill bit and VROP=volumetric rate of rock failure (drilling ROP multiplied by drill bit cross-sectional area).

The only downhole measurements (those made by sensors in the wellbore) required to solve the SMSE equation above are the output torque of the drilling motor plus any torque applied to the drill string at the surface, i.e., torque exerted by the drill bit, and the rotary speed of the drill bit while drilling. The product of these two parameters results in the mechanical power at the bit which is the sole subsurface term required in a method according to this aspect of the disclosure.

Output torque of the drilling motor may be estimated, for example, by measuring the pressure drop across the hydraulic power section of the drilling motor, or by using measurements made by torque sensors, e.g., strain gauges, positioned along the load path, which react to the applied torque load at the drill bit. These measurements may be determined anywhere along the bottom hole assembly with varying degrees of measurement quality. Rotary speed of the drill bit (RPM) may be determined directly, or indirectly, anywhere along the BHA. Some techniques for indirect determination of RPM will be explained further below. Within the drill bit, directly behind the drill bit, or along the drilling motor mechanical output drive transmission, the most common method for determining torque is to use mechanical strain gauges to measure rotary stress on the respective component. Measurement of rotary speed may be performed using accelerometers, gyroscopes, magnetometers, or strain gauges.

Pressure sensors or gauges may be used to measure the pressure drop (e.g., by placing one pressure gauge upstream of the drilling motor power section and one pressure gauge downstream of the power section) across the drilling motor power section. Such pressures may be used to determine pressure drop, which may be used to determine drill bit torque, e.g., using a pre-established relationship between pressure drop and torque.

Torque may be measured in the drill string above the drilling motor using strain gauges mounted onto a drilling assembly member. However, any frictional losses due to contact between the drilling assembly and the wellbore, excluding the drill bit, below the position of measurement will result in measurement of additional torque beyond that which is actually exerted by the drill bit.

Torque may also be determined by measuring pressure drop across the bottom-hole assembly and this is commonly performed at the surface. However, measurement made within the BHA as explained above has more resolution and accuracy. The pressure drop measurement may be made in various ways, but is most commonly made by measuring drilling assembly internal pressure and annulus (space between the wellbore wall and the drilling assembly) pressure, and determining the difference. Pressure drop measurement includes determining the pressure drop while the drilling assembly is off-bottom (drill bit suspended above the bottom of the bore hole) to establish a 'no-load' pressure drop measurement, and measuring pressure drop while drilling. The 'no load' measurement may be made at every drill collar stand connection, which is typically conducted after every 30, 60, or 90 foot interval of drilling depending on drilling unit operations. The 'no load' measurement includes 'side load' torque being reacted out while off-bottom and therefore causes the difference determined to represent less than the actual torque at the bit while drilling.

Above the drilling motor, measurement related to rotary speed may be made using, for example, accelerometers, gyroscopes, magnetometers, strain gauges, pressure gauges, acoustic receivers, or hydrophones disposed in the drilling assembly. In some embodiments, the foregoing sensor(s) may have the output(s) used to determine the distribution of the measurements into various frequency components. Peaks or local maxima in the measurement spectra may be used to identify the rotary speed of the drill bit as well as the rotor speed of a progressive cavity pump, rotary output speed of the drilling motor power section and the rotary speed of the drill string.

Using the drill bit gauge diameter, the cross-sectional area of the well bore being drilled is determined. In practice, the actual wellbore diameter varies along its length and this variance may be a source of error in determining power at the bit. Such error could be addressed with measurements from a wellbore caliper, but such instruments are frequently not available, particularly during drilling. Thus, in general practice it is assumed the cross-sectional area of rock mechanically failed is based only on the drill bit size.

The product of the cross-sectional area of the drill and the ROP represents the value of VROP at the surface. When coupled with the downhole value of Power@Bit, the value of SMSE can be determined as explained above.

Azimuthal, or directional determination of Power@Bit may be made using any known data sample binning process using, for example, measurements from magnetometers as the BHA rotates in the wellbore. When the drill bit intersects a formation boundary (or a feature in a formation separating layers having different rock strength or other property) from above or below, it appears as a sinusoid in azimuthally binned measurement data. By fitting the sinusoid to other formation measurement data, apparent and true dip angle and dip directions of the formation boundary may be determined. Azimuthal binning has been used with natural gamma ray measurements, spectral gamma ray, and density measurements to geo-steer a wellbore trajectory.

As explained previously, the mechanical power at the drill bit may be determined at a number of locations along the drilling assembly. Along the BHA or within a selected distance, e.g., 1,000 feet from the drill bit, sensor systems integral to or below a drilling motor, integral to a RSS, LWD, and/or MWD system may have a sensor set required to determine mechanical power at the drill bit. It can reduce sensor system complexity and reduce cost to operate when the sensor set is disposed within a MWD system placed above the drilling motor.

Surface determination of MSE is known to be used for drilling optimization to maximize ROP, as stated previously. It has also been used to perform engineered completion by strategically positioning hydraulic fracturing stages to group subterranean rocks along the target zone with similar lithology (mineral composition and grain structure), termed "like-rocks." More specifically, in extended lateral wells, the wellbore may enter and exit a target zone numerous times. Sections of a lateral well that are not within the target zone may not be need to be stimulated, e.g., by hydraulic fracturing. in completion operations. Furthermore, within the target zone, rock formation lithology properties may vary to some extent over the vertical depth as well as along the length of the lateral and thus, one or more "sweet spots" (zones having preferred petrophysical properties) may be identified. Such zones may be selected as targets to steer the well (control trajectory to remain within the zones) using one or more specific formation petrophysical properties such as rock mechanical strength, natural gamma ray, density, neutron porosity and acoustic travel time, among others as the steering parameter.

MSE is related to the energy supplied to the drill bit to fail a unit volume of rock and it therefore, is closely related to rock mechanical strength. Furthermore, accounting for drilling efficiency, the equation to determine unconfined compressive strength (UCS) of subsurface rock formations from drilling measurements has been established as:

$$UCS = MSE/\eta_{\text{drilling}} \tag{3}$$

where drilling efficiency ($\eta$) is defined as the ratio of energy that is actually used to fail the subterranean rock with respect to the total energy supplied to the drill bit. Energy lost to, inter alia, frictional forces results in heat being generated and vibrational energy that is transmitted along the BHA. Drilling efficiency may be approximated using sensors disposed along the drill string to measure a parameter related to the level of vibrational energy present in the drill string while drilling. In general, the higher the vibrational energy, the lower the drilling efficiency. On the surface, MSE is known to be used to approximate drilling efficiency based upon a predetermined relationship. SMSE determined as explained above may be used in a similar manner to determine drilling efficiency during drilling.

Currently, unconventional resource wells are geo-steered using natural gamma ray sensors to direct the trajectory of the well based on maintaining the gamma ray measurement within a selected range of a target value. Natural gamma ray sensors are often located in MWD tools, such tools being disposed 50 feet or more behind the drill bit, and are thus a lagging measurement of stratigraphic position of the wellbore. As explained above, at-bit or near-bit tools may provide sensors proximate to or in the drill bit, but such tools often do not include a gamma ray sensor and may not be deployed due to added tool complexity and far higher operating costs than other types of near-bit sensors. Determination of SMSE at the drill bit during drilling may be possible using low cost sensors such as strain gauges and accelerometers located in common drilling assembly components (e.g., MWD and LWD sensor systems disposed above the drilling motor) thereby avoiding unnecessary drilling assembly complexity to enable effectively geo-steering using, for example, UCS as a target parameter. In the present example embodiment, SMSE, determined as explained herein using measurement related to torque at the drill bit and drill bit rotary speed (RPM) may be used as a control parameter (as a proxy for UCS) for adjusting well trajectory during drilling.

Real Time Rock Mechanical Strength@Bit: Addition of Drilling Efficiency Determination As stated earlier, drilling efficiency may be approximated using drilling tool-disposed sensors to measure vibrational energy present while drilling. A vibrational energy amplitude may be determined using sensors known to be included in MWD sensor systems, such as accelerometers. In general, higher drill string vibrational energy during drilling is indicative of lower overall drilling efficiency. Thus, measurement of vibration amplitude may be suitable for a while-drilling determination of a drilling efficiency, which in turn may be used to determine an improved evaluation of UCS, as using vibrational amplitude may be an improvement over a mere predetermined drilling efficiency relationship based on MSE.

A drilling assembly may be represented as a spring-mass system. When vibrations are present in a drilling assembly, the total energy due to vibration is the sum of kinetic, or motion energy and potential, or stored energy in the spring deflection. In theory, the total energy remains the same for a given level of vibration as kinetic energy turns into stored energy and then stored energy turns into kinetic energy. In practice, there are frictional losses, termed damping, that would show up as heat generation but for purposes of the present disclosure it is only necessary to be concerned with determining the total energy level of the vibration during drilling operations.

The total energy of a spring-mass system is known to be described as:

$$\text{EnergyVIB}=0.5\times\text{mass}\times\text{vmax}^2 \quad (3)$$

where mass is the total mass and vmax is the maximum velocity. When determining the relative energy level between two vibration states of the same system, the total mass term cancels out. That is, the ratio of total energy between two levels of vibration may be simply described as:

$$\text{EnergyRatio}=(\text{vmax2})^2/(\text{vmax1})^2 \quad (4)$$

where the relative energy level of a spring-mass systems may be expressed as the ratio of the square of maximum velocities experienced. This ratio may be applied at any location along a drilling assembly to determine the relative energy level of varying states of vibration experienced.

Thus, the vibrational energy level may be determined from the summation of maximum vibrational energy detected using axial, lateral, and torsional motion measurements. Low cost, highly repeatable MEMS-based accelerometers, magnetometers, and gyroscopes may be suitable for these measurements and are commonly used within drilling tools having sensors.

As a theoretical matter, when drilling efficiency approaches zero, the ROP also approaches zero, or more simply stated, subterranean rock is not failing notwithstanding energy being supplied to the drill bit. Likewise, when drilling efficiency approaches unity, or 100 percent, there are essentially no drilling energy losses and ROP is the maximum possible. In practice, when drilling efficiency may be considered maximum, a percentage change in mechanical power delivered to the drill bit will result in a corresponding change in ROP. In the same manner, when a change in mechanical power delivered to the drill bit does not result in a corresponding change in ROP, then drilling efficiency has decreased.

Therefore, it is possible to establish a relative level of vibrational energy that represents maximum, or 100%, drilling efficiency as well as any lower drilling efficiency. A result is a linear relationship between the level of vibrational energy and drilling efficiency. Such relationship may provide an improvement to determination of real time drilling efficiency based on subterranean sensors, which in turn, may be used to calculate UCS.

The measured vibrational energy level and its amplitude range are dependent upon the physical location of the sensors relative to the drill bit, and how well the sensors are structurally coupled to the drill string. The structural coupling of widely used drilling assemblies allow for these sensors to be packaged in numerous locations along the BHA using drilling tool configurations known in the art.

The determination of drilling vibration energy at the drill bit may be processed at a number of locations. Along the BHA or within 1,000 feet of the drill bit, sensor systems integral to or below a drilling motor, integral to a RSS, LWD, and/or MWD may accommodate the sensor set required to determine vibration energy level at the drill bit. The least complex and lowest cost to operate approach is to package the sensor set within a MWD system placed directly above the drilling motor in the two predominant BHAs used currently to drill UR wells as identified above.

A more accurate determination of drilling efficiency may be obtained and this may lead to an improved determination of UCS. As discussed previously, the need to position a well bore by geo-steering using subterranean rock mechanical strength properties is driven by expected production improvements gained with engineered completion processes that group rocks of similar lithology.

Prediction of At-Bit Lithology Using Machine Learning Models:

As previously discussed, a method for calculating a value of rock mechanical strength based on a determination of mechanical power at the drill bit and further improved with a determination of drilling efficiency was presented. It is well known that several lithology properties correlate strongly to subterranean rock mechanical strength.

In particular, lithologic properties that are related to the structural (grain structure and size distribution) make-up of the subterranean rock as well as measures of any natural fracture network such as density, porosity, and natural gamma ray may be used in various embodiments. For example, for unconventional resource target zones, the level of natural gamma radiation is known to be inversely related to the rock mechanical strength such that the harder the rock is to drill, the lower the corresponding natural gamma ray level that will be observed. As another example, the greater the rock fractional pore space (porosity), lower density or presence of more numerous natural fractures, the easier the subterranean rock fails. Thus, rock strength may relate inversely to rock porosity, whether determined using neutron porosity detectors or density measurements.

UCS, a lithology-related measurement, is known to be related to MSE and drilling efficiency and, as previously explained herein, sensor measurement may be used to determine those relationships accordingly. Together, these relationships establish a physics-based foundation for introduction of machine learning techniques, to determine more refined relationships between these same sensor measurements, and an industry accepted sensor measurement related to lithology. More specifically, sensors located along the BHA, as discussed previously, may be complimented with developed ML models to predict natural gamma ray, density, porosity, rock mechanical strength, as well as natural fracture network characteristics at the cutting surface of the drill bit, while drilling in underway.

The effectiveness of ML models depends upon accuracy and repeatability of sensor measurements as well as general consistency of drilling operations and subterranean lithology. Today, the following facts further provide a strong foundation for implementation of ML techniques,

- high quality sensors have been made available thru advancements in electronics components such as MEMs
- UR development has been termed, factory drilling, where multiple wells are drilled at a given location, or basin, with structurally similar drilling assemblies
  - targeting the same strata in a particular basin
  - in the same direction with respect to geo-mechanical stress state In general, a ML technique is applied to a set of input variables along with a known output evaluation to uncover the best relationship between the two. For a structural system, such as a drilling assembly, ML techniques will be able to determine important nuances resulting from real structural complexities that may not be practical with even the best direct modeling techniques.

Therefore, a drilling assembly that has sensors required to determine mechanical power at the bit and relative drilling efficiency, in connection with developed ML models (whether at surface or in a processor in the drilling assembly), may be used to predict lithology parameters proximate the drill bit, thereby eliminating the need to include lithology-related parameter sensors in the drilling assembly, particularly proximate the drill bit.

The same measurements required to determine mechanical power at the bit along with vibration energy level while drilling may be used as input variables to the ML models. Output parameters from the ML models are the lithology parameters to be predicted. The lithology parameters may be obtained from sensor systems (typically LWD tools comprising gamma ray, resistivity, acoustic velocity, density and/or neutron porosity sensors) that were present in the same drilling assembly as the sensors to be used as input variables. Together the input variable and lithology related parameter measurements may be used to generate historic data sets.

The historic data sets may be used to develop, train, and verify ML model(s). Developed ML models may then be used with only the sensors that support the input variables (related to power and the bit and vibration) to be used to predict lithology parameters.

In addition, characterization of the rock failure may need to be refined further. Characteristics of rock failure vibration energy may be determined by power spectrum analysis of:

- axial, lateral, torsional vibrations;
- fluid vibrations in pressure transducers, acoustic receivers, hydrophones;
- rotary speed of drilling motor, of drill bit, of drill string; and
- torque, axial, lateral strains.

These analyses can identify responding frequencies and their relative magnitude, producing a type of unique identification to assist in ML model development.

With these measurements and their associated processing as input variables, developed ML models may be used to determine complex input features and their relationships to provide predicted lithology parameters that may accurately discern expected changes in natural gamma ray, density, porosity, or other subterranean rock properties while drilling. This, in turn, may enable more optimal placement of wellbore during directional drilling.

Machine Learning (ML) is part of the field of study known as artificial intelligence. ML includes many different modeling methods and algorithms. Random Forest and Neural Networks are two ML methods that are commonly used for modeling complex systems. Machine learning modeling techniques are actively advancing and the intent of present invention is to use which ever machine learning algorithm(s) is found to provide the best results.

Furthermore, azimuthal binning process may be applied to predicted lithology measures to provide directional images. These may also be used in geo-steering methods.

FIG. 6, described previously in detail, shows one example of providing a predicted real-time lithology measurement at the cutting surface of the bit using MWD tool 140 with sensor system 330 in any common BHA.

This method may be implemented at a number of locations along the BHA or within approximately 1,000 feet of the drill bit. Sensor systems integral to or below a drilling motor, integral to a RSS, LWD, and/or MWD may accommodate the sensor set required to provide input measurements to developed ML models, tuned to predict lithology at the drill bit. Cost and complexity may be reduced by packaging the sensor set with developed ML models loaded on a processor or similar device within a MWD system placed directly above the drilling motor in either of the two types of BHAs described above as being used to drill lateral wells as explained above.

Methods to approximate industry standard measures of lithology without the need for such sensors in a drilling assembly may be practical with developed ML models. Such developed ML models may allow well operators to use the knowledge gained from a few early wells drilled with complex and expensive LWD sensors, to assist geo-steering remaining wells drilled within a particular target zone of a particular basin. Developed machine learning models deployed with low cost sensor sets may enable predicting LWD measurements for use in real time operations.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for determining mechanical specific energy of a drill bit drilling a subsurface formation, the drill bit rotated by a drilling motor in a drilling assembly, the method comprising:

- measuring a parameter related to torque applied to the drill bit while drilling the subsurface formation;
- measuring a parameter related to rotational speed of the drill bit by analyzing frequency distribution of a measurement made on a side of the drilling motor opposite to the drill bit while drilling the subsurface formation;
- determining a volumetric rate of penetration of the drill bit through the subsurface formation; and
- calculating the mechanical specific energy from the parameter related to torque, the parameter related to rotational speed and the volumetric rate of penetration.

2. The method of claim 1 further comprising binning the calculated mechanical specific energy with respect to a measure of azimuth and using the binned, calculated mechanical specific energy to adjust a trajectory of a wellbore during drilling.

3. The method of claim 1 wherein the parameter related to rotational speed comprises magnetic field amplitude.

4. The method of claim 1 wherein the parameter related to rotational speed comprises acceleration.

5. The method of claim 1 wherein the parameter related to torque comprises torsional strain.

6. A method for determining power of a drill bit drilling a subsurface formation, the drill bit rotated by a drilling motor in a drilling assembly, the method comprising:

measuring a parameter related to torque applied to the drill bit while drilling the subsurface formation;

measuring a parameter related to rotational speed of the drill bit by analyzing frequency distribution of a measurement made on a side of the drilling motor opposite to the drill bit while drilling the subsurface formation; and calculating the power from the parameter related to torque and the parameter related to rotational speed.

7. The method of claim 6 further comprising binning the calculated power with respect to a measure of azimuth and using the binned, calculated power to adjust a trajectory of a wellbore during drilling.

8. The method of claim 6 wherein the parameter related to rotational speed comprises magnetic field amplitude.

9. The method of claim 6 wherein the parameter related to rotational speed comprises acceleration.

10. The method of claim 6 wherein the parameter related to torque comprises torsional strain.

11. A method for predicting a lithology-related parameter of a formation at a drill bit during drilling a wellbore, comprising:

measuring a parameter related to power expended at the drill bit during the drilling, the parameter related to power comprising at least one measurement made proximate the drill bit;

measuring a parameter related to vibration energy in a drilling assembly during drilling;

using measurements of the parameter related to power and measurements of the parameter related to vibration energy and corresponding measurements of the lithology-related parameter as input to train a machine learning model; and using only (i) the measured parameter related to power and (ii) the measured parameter related to vibration energy in the trained machine learning model to predict a value of the lithology-related parameter being drilled by the drill bit.

12. The method of claim 11 wherein the parameter related to power comprises a parameter related to torque at the drill bit and a parameter related to rotational speed of the drill bit.

13. The method of claim 12 wherein the parameter related to rotational speed comprises magnetic field amplitude.

14. The method of claim 12 wherein the parameter related to rotational speed comprises acceleration.

15. The method of claim 12 wherein the parameter related to torque comprises torsional strain.

16. The method of claim 12 wherein the parameter related to vibration comprises axial acceleration, lateral acceleration and rotational acceleration.

17. The method of claim 11 wherein the lithology-related parameter comprises at least one of density, neutron porosity, gamma ray radiation, resistivity and acoustic velocity.

18. The method of claim 11 wherein the corresponding measurements are made by at least one sensor disposed on the drilling assembly on a side of a drilling motor opposed to a side thereof on which the drill bit is disposed while the wellbore is being drilled by the drill bit.

19. The method of claim 11 wherein the corresponding measurements are made by at least one sensor disposed on the drilling assembly between a drilling motor thereon and the drill bit while the wellbore is being drilled by the drill bit.

20. The method of claim 11 further comprising binning the predicted lithology-related parameter with respect to a measurement of azimuth, and using the binned parameter to adjust a trajectory of the wellbore during drilling.

21. The method of claim 11 further comprising binning the parameter related to power with respect to a measurement of azimuth, and using the binned parameter to adjust a trajectory of the wellbore during drilling.

22. A method for adjusting trajectory of a well during drilling, comprising:

measuring a parameter related to power expended by a drill bit penetrating subsurface formations during the drilling;

binning the measured parameter related to power with respect to a measurement of azimuth; and using the binned parameter to adjust the trajectory of the wellbore during drilling.

23. The method of claim 22 wherein the parameter related to power comprises rotational speed of the drill bit.

24. The method of claim 23 wherein the rotational speed is determined from a frequency distribution of measurements made by at least one of an accelerometer, a gyroscope, a magnetometer, an acoustic receiver and a hydrophone.

25. The method of claim 24 wherein the at least one of an accelerometer, a gyroscope, a magnetometer, an acoustic receiver and a hydrophone are disposed on a side of a drilling motor opposed to a side thereof on which the drill bit is disposed.

26. The method of claim 22 wherein the parameter related to power comprises torque.

* * * * *